US005509331A

United States Patent [19]

Nickipuck

[11] Patent Number: 5,509,331

[45] Date of Patent: Apr. 23, 1996

[54] GEAR DRIVE RATCHET ACTION WRENCH

[76] Inventor: Michael F. Nickipuck, 1323 W. Cossitt Ave., LaGrange, Ill. 60525

[21] Appl. No.: 400,552

[22] Filed: Mar. 8, 1995

Related U.S. Application Data

[63] Continuation of Ser. No. 45,990, Apr. 9, 1993.

[51] Int. Cl.[6] ..... B25B 13/46

[52] U.S. Cl. ..... 81/58.3; 81/58.4; 81/59.1

[58] Field of Search ..... 81/58, 58.3, 58.4, 81/59.1, 60–63, 63.1, 63.2

[56] References Cited

U.S. PATENT DOCUMENTS

| | | | |
|---|---|---|---|
| 249,003 | 11/1881 | Cherry | 81/58.3 |
| 994,804 | 6/1911 | Wahlstrom | 81/177.85 |
| 1,746,387 | 2/1930 | Faw | 81/177.85 X |
| 2,474,360 | 6/1949 | Jimerson | 81/177.85 X |
| 3,823,625 | 7/1974 | Myers | 81/59.1 |
| 4,924,737 | 5/1990 | Gummon | 81/63.2 |
| 4,939,961 | 7/1990 | Lee | 81/60 |

*Primary Examiner*—D. S. Meislin

*Attorney, Agent, or Firm*—David C. Brezina; Lee, Mann, Smith, McWilliams, Sweeney & Ohlson

[57] ABSTRACT

The invention is a rotating driver tool which uses a housing having a chamber with a drive gear that drives and ratchets with a driven gear, which is biased by coaction of springs and camming balls between an engagement and disengagement by action of a cam on the balls.

18 Claims, 7 Drawing Sheets

GEAR DRIVE RATCHET ACTION WRENCH

This application is a continuation, of application Ser. No. 08/045,990, filed Apr. 9, 1993.

BACKGROUND OF THE INVENTION

1. Field of the Invention

The invention provides a ratcheting action wrench for driving fasteners having an opening in a housing through which a shank projects with gear teeth formed in the housing. Two embodiments are taught, each having advantages. The preferred embodiment has a plurality of internal ring gear teeth, while an alternative embodiment has crown type teeth on a shelf surrounding the shank opening. In the two embodiments, a driven geared drum, or gear with corresponding teeth to the housing gear selectively engages and disengages as the housing is turned. The engagement of the driven gear and drive gear is accomplished through a biasing assembly using a cam wheel aligning internally carried ball bearings retracting and extending from recesses. In the preferred embodiment, the geared drum normally has the respective gears engaged, while in the crown gear arrangement, the normal position has the gears disengaged. The use of rotation around an axis to actuate the camming balls to bias an assembly by moving the assembly in an axial rather than rotary direction is common in both embodiments.

2. Description of Related Art

Ratchet wrenches using gears shaped like spur gears, with straight teeth parallel to the axis of rotation, engaged by pawls, are well known. Arranging a plurality of pawls and providing them with a reversible configuration enables reversing of the prior art ratchet wrench. The mechanism in this prior art is a commonly referred to as a ratchet while in this application the different structures' function is referred to as a ratchet action because it uses a different mechanism.

The prior art shows the general concept of using ball bearings as camming elements in the wrench field. Typically these applications are to retain a removable wrench socket on a square drive using a spring loaded retainer ball or a positively positioned retainer ball which may be locked in place. When ball bearings are used as camming elements typically the ball bearings in these structures operate on fairly infrequent duty cycles as opposed to repetitive cycles in a ratchet or a ratchet action mechanism.

SUMMARY OF THE INVENTION

A ratchet action rotary driver tool is used for driving fasteners by cycling through a drive and a return stroke in which forces transmitted to the fastener during driving and the wrench is returned to a position to begin another drive stroke. Ratchet action wrenches, screwdrivers or other fastener drivers have advantages over fixed fastener drivers in their ability to better take advantage of application of muscle power, apply force in limited space, and avoid removal and replacement of the fastener driver or the hand of a mechanic or both.

The ratchet action driver tool has a housing with a drive chamber and a shank opening. A shank passes through the opening, completely through the housing and rotates with the housing on a drive stroke letting the housing return to a desired position on a return stroke for application of another drive stroke.

Mounted on said shank is a driven gear which slides vertically, or axially, on the shank. For the purposes of this application, the terms vertical, side, horizontal, and the like are used in a relative sense with reference to the drawings and not by way of limitation to the actual use of the driver tool which in the field is frequently used in an infinite variety of angles and positions, even overhead or "upside down". Axial refers to the axis of rotation of the fastener drive.

A drive gear assembly is formed in the chamber of the housing. In the alternative embodiments this can be on the inside, cylindrical surface of the chamber, the teeth projecting inwardly, as is preferred, or alternatively in the form of a shelf surrounding the shank opening. The drive gear has a plurality of teeth corresponding in geometry to those of the driven gear. Thus in the ring gear embodiment, gears outwardly project from a drive drum in the manner of spur gears to mesh and disengage from the inwardly projecting drive gears of the housing. These straight cut teeth are aligned with their principal axis parallel to the axis of rotation of the tool. This is believed to be the best embodiment under current machining art, combining significant strength, enabling compact size, with relative ease of machining. The alternative embodiment has other features.

In the crown gear embodiment, on both of the gears, the teeth are aligned radially with their axes perpendicular to the axis of rotation. In this crown embodiment, forty eight teeth having a profile having radiused tips and grooves, and being tapered as they diverge from the center, are believed to be an optimum configuration where precision casting or forging is desired to be utilized. This may also be molded in plastic for economy and light weight.

A biasing assembly is carried on the shank with a cam wheel providing recesses for ball bearings. In the preferred ring gear embodiment, the gears are normally engaged by spring pressure, with biasing on rotation on the return stroke disengaging the gears. In the crown gear embodiment, the gears are normally disengaged, with biasing occurring on the drive stroke.

The camming recesses are on the internal lower surface of the cam wheel. On its exterior perimeter the cam wheel is knurled to permit the operator to rotate the cam wheel thereby aligning the ball bearings for a clockwise (tightening) drive stroke, a counterclockwise (loosening) drive stroke, or a fully locked position where either direction is directly transmitted to the fastener.

The biasing assembly uses the cam wheel to force balls carried in nesting recesses in the driven gear from recesses in the cam wheel. In the preferred ring gear embodiment, the teeth are vertically spaced and interrupted so that spring pressure maintains the gears in engagement until rotation forcing the camming balls biases the drum axially. Corresponding interruptions in the ring gear array in the housing permit free rotation of the housing around the shank on a return stroke. The disengagement in this embodiment is caused by camming surfaces interposed between the cam wheel recesses.

In the crown gear version the camming of balls forces the driven gear into engagement with the drive gear of the housing on a drive stroke, and permitting the ball bearings to retract on a return stroke.

Selection of the recess alignment of the cam wheel is accomplished by rotating the knurled portion of the cam wheel relative to shank and housing. In the crown gear embodiment, this is accomplished by depression of a push button carried on the shank biased upwardly by a spring. Depressing the push button releases locking balls. In the locking position, the push button is biased upwardly forcing a camming cone upwardly and forcing the balls outwardly into the apexes of a generally square shaped aperture in the cam wheel.

BRIEF DESCRIPTION OF THE DRAWINGS

FIG. 3*a* is a section of the drive end of the shank, the shank section being aligned as shown in FIG. 1.

DETAILED DESCRIPTION OF THE CROWN GEAR EMBODIMENT

Figure 2:
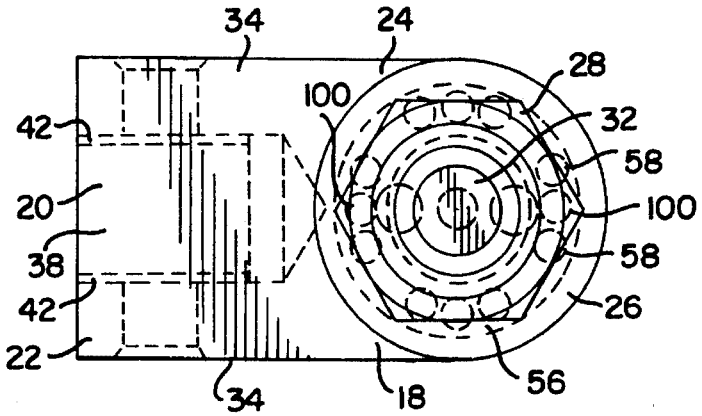
FIG. 2 is a top plan view of the crown gear drive ratchet action wrench.
Figure 1:
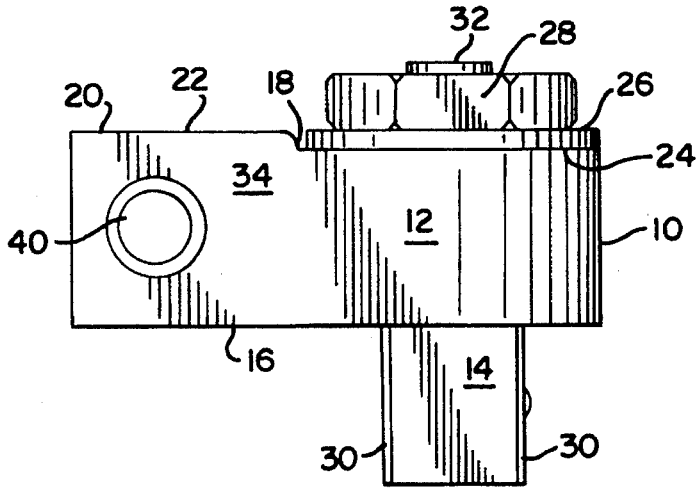
FIG. 1 is an elevational view of the crown gear drive ratchet action wrench.

A driver tool 10 has a housing 12 with a projecting shank 14 extending outwardly from the bottom 16 of the housing 12. The top 18 includes a handle receiver 22 and a bearing surface 24. Borne on bearing 24 is cam wheel 26. The shank 14 and cam wheel 26 assembly is retained in the housing by clamping or otherwise retaining the assembly in the housing 12 using nut 28. This clamping or fastening arrangement is used in the crown gear embodiment but other clamping or fastening methods such as pins, circlips, collars and set screws could also be used. In the crown gear embodiment clamping nut 28 draws shank corners 30 against bottom surface 16.

Figure 3:
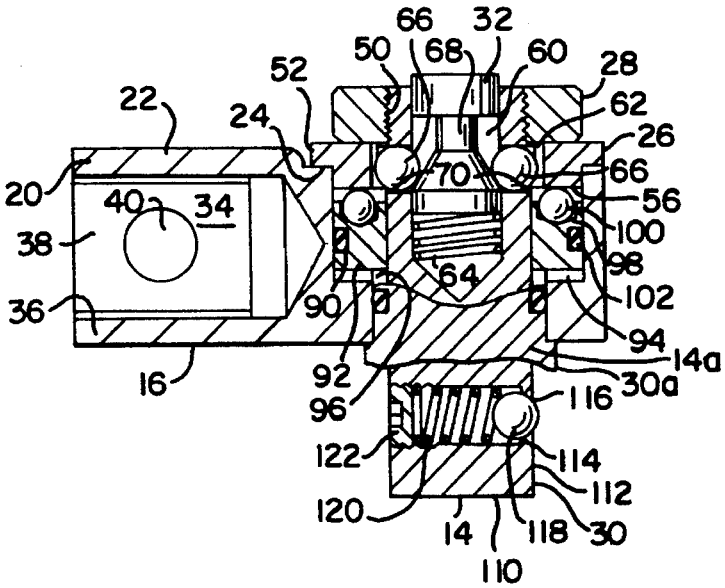
FIG. 3 is a sectional view of the crown gear drive ratchet action wrench with the entire shank rotated 45 degrees relative to the arrangement shown in FIG. 1.

It will be noted that in FIG. 3*a*, shank 14 has its lower portion 14*a* rotated 45 degrees in section. Extending above nut 28 and visible in section in FIG. 3 and in plan in FIG. 2 is pushbutton 32.

In the crown gear embodiment, housing 12 having handle receiver 22 with the top of the housing 18 formed by web 20, receiver walls 34. and bottom web 36 defining handle aperture 38. Aperture 38 can be adapted to receive a square drive having the same proportions as shank 14 particularly, in the crown gear embodiment, the pivoting socket wrench handle known as a "breaker bar". Adaptation of the housing in the crown gear embodiment for this particular purpose does not limit adaptation of the drive mechanism of the invention to other alternatives such as a housing cast or forged integrally with a lever type handle or forming the housing integrally with a screwdriver type handle or the like. Hole 40 in receiver walls 34 permits receiving of a retainer ball, insertion of a set screw or use of a pin to hold the handle in place.

Hole 40 has its outer edges chamfered and its inner edges within handle aperture 38 cast with a slight step 42 all to provide for improved manufacturing to required tolerances by minimizing deburring to only the exterior. The stepped portions 42 eliminating the need for interior deburring.

FIG. 3 shows the components of the mechanism in section. Threads 50 on shank 14 correspond to those on nut 28. Cam wheel 26 includes edge 52 knurled or otherwise surface prepared for gripping in the crown gear embodiment and the internal cam segment 54 including cam surface 56, cam recesses 58 which enable the ratcheting action. Shank 14 projects upwardly through cam wheel alignment aperture 60 defined by a plurality of walls 62.

Control of the alignment of cam wheel 26 is a accomplished by depressing button 32 against biasing spring 64, thereby permitting alignment balls 66 to move inwardly adjacent cylinder 68 of button 32, balls 66 being carried in transverse apertures 70 in shank 14. The transverse, inward movement of balls 66 releases their contact against concave walls 62 thereby providing clearance for rotation of cam wheel 26 to change alignment of selected camming recesses 58 to determine the direction of the drive and return strokes. Upon selection of the position of cam wheel 26 and release of button 32, biasing spring 64 forces button 32 upward conical section 72 biasing balls 66 outward against notched walls 62 the button 32, spring 64 and ball 66 assembly thereby provides a selection and locking assembly. The notching arrangement is shown with more particularity in FIG. 9, a sectional view of the cam wheel selection and locking arrangement.

Figure 4:
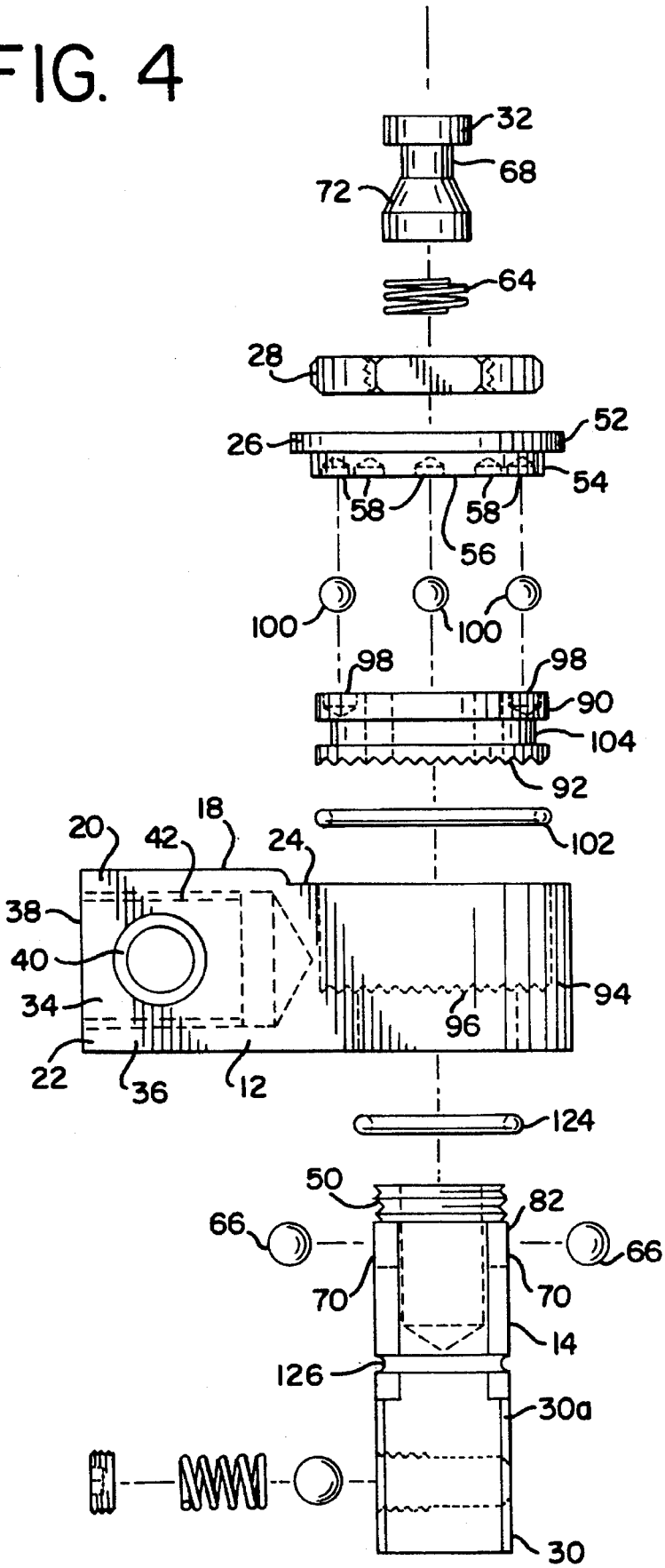
FIG. 4 is an exploded view showing the components of the crown gear drive ratchet action wrench.

It will be observed from the drawing (FIG. 4) that the teeth on gear 90 may be seen to be bilaterally symmetric, that is they have similar halves flanking a median plane in the principal axis of the body. For each tooth, the median plane is aligned along the radius from the axis of the shank 14 to the apex of the tooth. The respective sides or faces of each individual tooth is a mirror image of the other, thus rotation in either direction results in essentially identical geometry.

Figure 9:
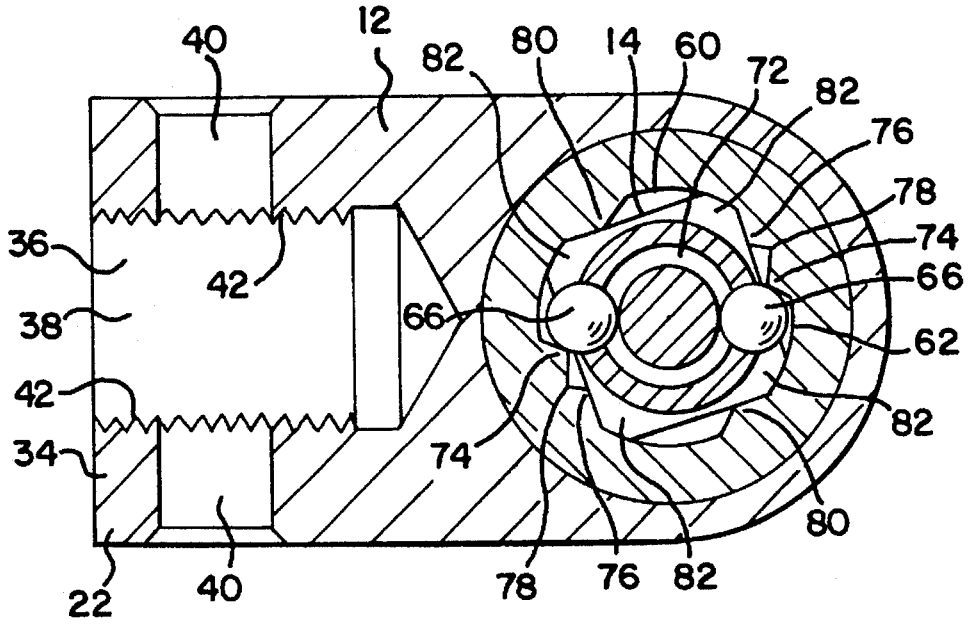
FIG. 9 is a sectional view of the crown gear drive ratchet action wrench locking assembly.
Figure 10:
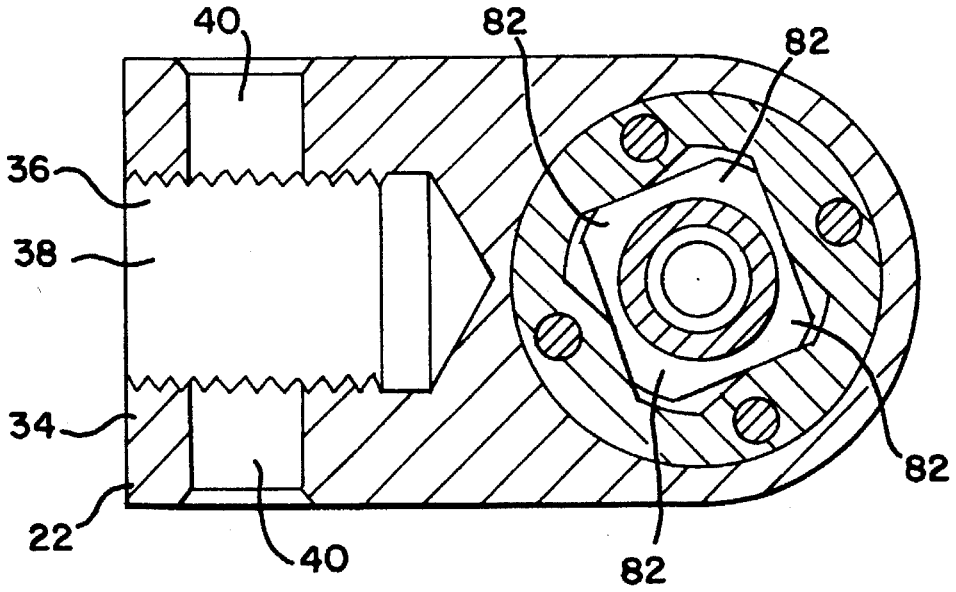
FIG. 10 is a sectional view of the crown gear drive ratchet action wrench drive ball assembly.

Walls 62 are generally formed with projecting left shoulder 74 and right shoulder 76 defining notch 78 therebetween. Positioned 90 degrees from notch 78 is projecting lug 80 which provides for a stop bearing against top corner 82 of shank 14. Vertical movement of conical section 72 permits rotation of wheel 26 for alignment of balls 66 either against selected shoulder 74 or 76 for ratchet action movement or in notch 78 for a fully locked shank 14 in relation to housing 12. Also notable in FIG. 9 is the section showing step 42 as previously described providing a relieved area to avoid the need for deburring the edges of hole 40 after machining.

Loads are transmitted to shank 14 from housing 12 as the housing is rotated to drive a fastener such as a nut or bolt using, standard square drive socket wrench sockets. The mechanism is adaptable for driving other members such as a hex drive rather than a square drive or for the driving of other tools such as screwdriver bits or the like. The driving force and ratcheting action is provided by the interaction of a driven gear 90 having an array of teeth 92 aligned on its bottom surface in a crown fashion with the teeth pointing downwardly and extending along radii from the drive axis. Teeth engage corresponding teeth on a shelf 94 formed in the perimeter of the shank aperture 96. The camming and releasing action of the biasing assembly and specifically the cam wheel 26 is provided by a plurality of nesting recesses 98 in which are seated drive balls 100. The biasing assembly bears on one side of driven gear 90 and thereby urges driven gear 90 downward which action tends to bias teeth 92, 94 into engagement. In the crown gear embodiment, this position is maintained by the elastomeric properties of O-ring 102. O-ring 102 is carried in annular groove 104 on gear 90. Alternative embodiments may use springs or even magnets to bias the teeth 92, 94 into engagement. As shown, this O-ring 102 contacts the gear 90 on one side of its cross section, and the housing 12 on the other. Vertical movement of the gear 90 imparts a torque on the O-ring.

Shank 14 has a drive portion 110 comprised of walls 112 in the crown gear embodiment for driving a socket wrench socket. In order to retain that socket, the crown gear embodiment contemplates machining a bore 114 including a passageway 116 of a diameter less than a retainer ball 118 so that the retainer ball projects therefrom biased by spring 120. Bore 114 extends at its diameter substantially the entire distance between walls 112 and in conjunction with passageway 116 communicates the entire distance from wall to wall through the entire shank 14. The wall opposite retainer ball 118 is then fitted with a set screw 122 which functions both to close one end of the bore 114, provide a surface against which the spring 120 biases ball 118 and provides for adjustment of the tension of spring 120. This is a departure over typical socket wrench art in which a blind bore has a spring and then retainer ball inserted and the opening to the bore is then pressed to distort the wall inward to retain the ball. The requirement of malleability of the prior art shank requires metallurgy of less desirable strength and hardness then does the embodiment's set screw version. Nevertheless, use of the blind bore retainer ball arrangement in production models would not depart from the ratchet action wrench of the invention. The driven gear 90 and drive portion 110 in this crown gear embodiment provide the operative connection between the housing 12 and the shank 14 for driving. The drive portion 110 is to mate with the driven gear 90, said driven gear 90 being arranged as a peripheral drive ring, which surrounds the shank 14 and shank aperture 96.

In order to effectuate the desired gear engagement and disengagement of the shelf drive gear 94 and driven gear 90, a shank O-ring 124 is carried in shank groove 126. This provides for friction in the rotation of shank 14 in opening 96 to provide the housing 12 to slightly lead the shank 14 on the shift in direction from a return stroke to a drive stroke so that balls 100 force gear 90 into engagement.

Figure 5:
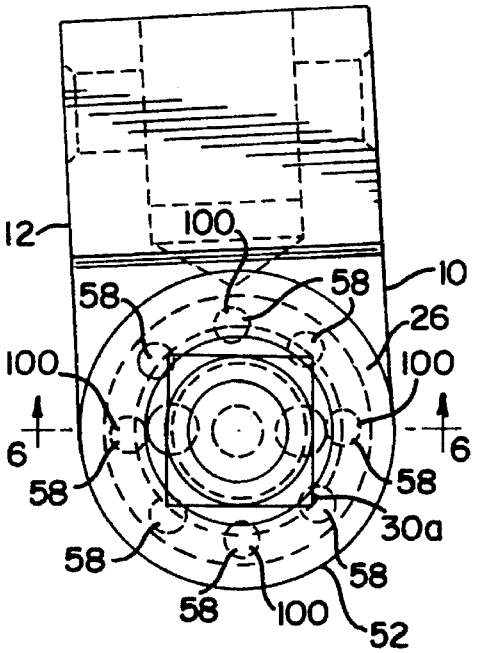
FIG. 5 is a bottom plan view of the crown gear drive ratchet action wrench on a return stroke.
Figure 7:
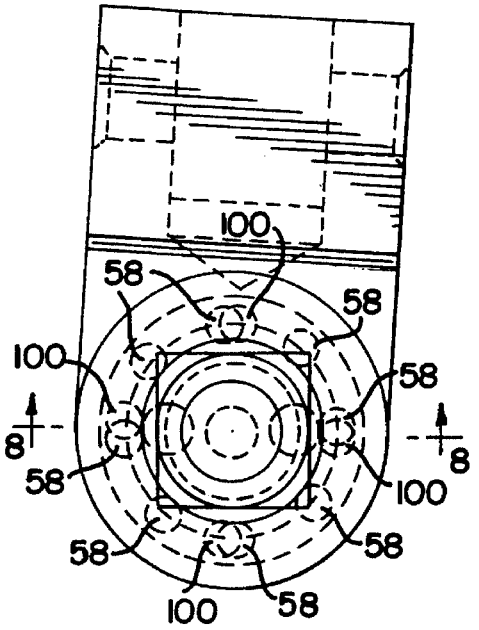
FIG. 7 is a bottom plan view of the crown gear drive ratchet action wrench on a drive stroke.
Figure 6:
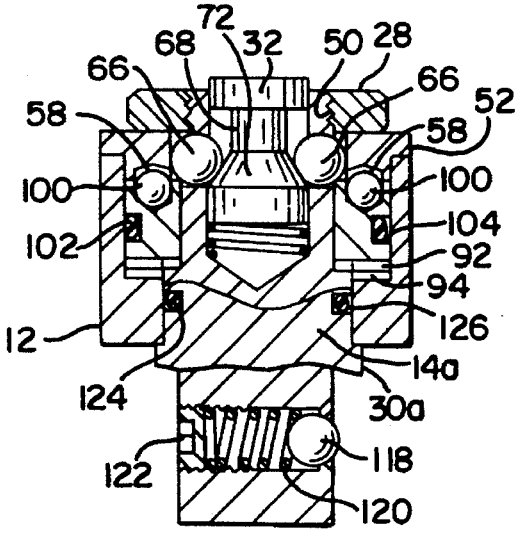
FIG. 6 is a sectional view of the crown gear drive ratchet action wrench on a return stroke.
Figure 8:
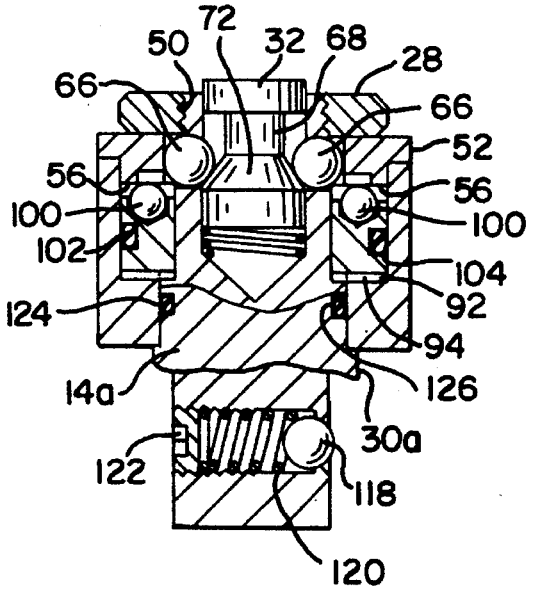
FIG. 8 is a sectional view of the crown gear drive ratchet action wrench on a drive stroke.

The ratchet action operation of the invention is particularly shown in FIG. 5 through FIG. 8. A comparison of FIG. 5 and 6 showing a return stroke and FIG. 7 and FIG. 8 showing the drive stroke illustrates the ratchet action.

Now referring to FIG. 5 and 6 in the ratcheting or return stroke position and FIG. 7 and FIG. 8 in the engaged or drive stroke position, the operation of the ratchet action wrench will be seen. FIG. 5 shows that drive balls 100 and, the nesting recesses 98, in which they are contained, and the camming recesses 58, that is, these camming recesses are, in this position, concentric with the balls, thereby enabling the balls 100 to retract therein are concentric. As shown in FIG. 6 this permits the drive balls to fit upwardly into the camming recesses 58, that is, these camming recesses are, in this position, enabling the balls 100 to retract therein, as biased by the combined action of O-ring 102 and teeth on gear 94 as against teeth on gear 92. The inclined surfaces of each tooth bear against the corresponding teeth to provide an upward resulting force on driven gear 90. It can be seen in FIG. 6 that the respective driven 92 and drive 94 gear teeth are separated by this relative upward movement of gear 90.

Now referring to FIG. 7, it can be seen that drive balls 100 are no longer concentric with any of camming recesses 58. Here the camming recesses 58, co-acting with surface 56 perform the camming function. This relative displacement shown in FIG. 8 displaces driven gear 90 downwardly by virtue of cam surface 56 now bearing on balls 100. This forces gear teeth 92, 94 into engagement and thus rotation of housing 12 directly drives shank 14 to turn a fastener through the action of a tool fitted to the shank such as a socket wrench or socket screwdriver. The cam wheel 26, balls 66, driven gear 90 and O-ring 102 in this crown gear embodiment comprise the biasing assembly which with the drive ring and drive portion 110 provides the operative ratcheting action of the tool enabling ratcheting action between the housing and the shank for driving fasteners or otherwise transmitting rotary motion for mechanical advantage.

DETAILED DESCRIPTION OF THE PREFERRED RING GEAR EMBODIMENT

A driver tool 210 has a housing 212 with a projecting shank 214 extending outwardly from the bottom of the housing 212. The housing 212 supports an O-ring 222. Borne on O-ring 222 is cam wheel 226. The shank 214 and cam wheel 226 assembly is retained in the housing by clamping or otherwise retaining the assembly in the housing 212 using a recessed screw 228. Shank 214 is formed so as to have a ring structure 230. In the preferred embodiment retaining screw 228 draws ring 230 against inner bearing 216.

Figure 11:
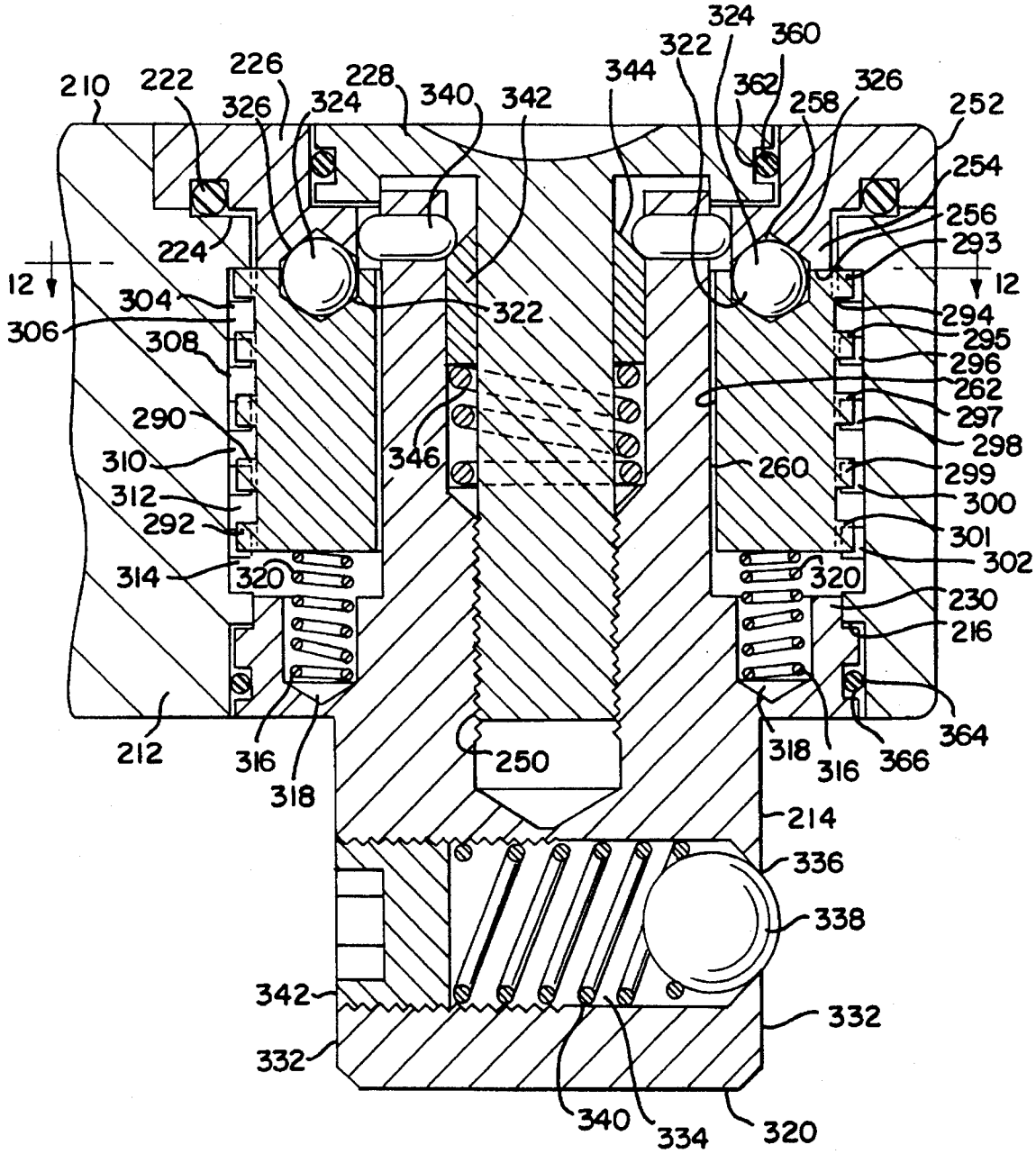
FIG. 11 is a side sectional view of the preferred embodiment.

FIG. 11 shows the components of the mechanism in section. Threads 250 in shank 214 correspond to those on screw 228. Cam wheel 226 includes edge 252 knurled for gripping. Cam segment 254 includes cam surface 256 and cam recesses 258 which enable the ratcheting action. Shank 214 projects upwardly through drum 260 by extending through an aperture defined by walls 262.

The preferred embodiment has the gears in a normally engaged position. This permits rotation of the cam wheel 226 to realign the sets of camming recesses 258 and nesting recesses 322 in the appropriate angular relationship for either a clockwise (fastener tightening) or counterclockwise (fastener loosening) drive stroke. Control of the alignment of cam wheel 226 in this embodiment can be compared to the crown gear embodiment.

Figure 12:
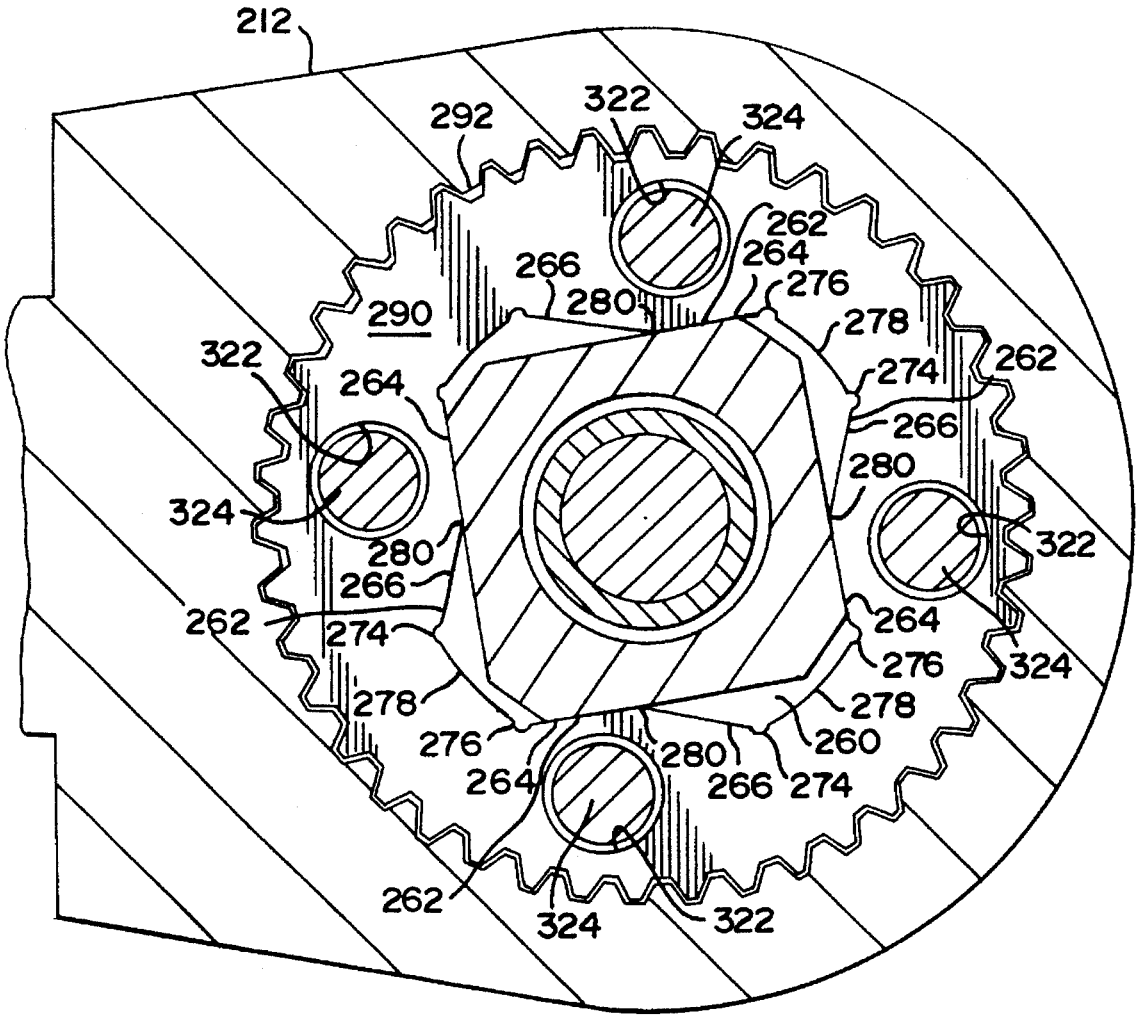
FIG. 12 is a top sectional view of the preferred embodiment.

As shown in FIG. 12, in drum 260, convex or "Vee" shaped walls 262 are generally formed of drive portions 264, 266 with undercut corners 274 and 276 having concave wall 278 therebetween. Positioned 90 degrees from the center of concave wall 278 is projecting wall apex 280 in the convex wall. Depending on the direction of rotation, portions 264 or 266 alternatively drive shank 214.

It will be observed from the drawings (FIG. 12 and FIG. 14) that the teeth may be seen to be bilaterally symmetric, that is they have similar halves flanking a median plane in the principal axis of the body. For each tooth, the median plane is aligned along the radius from the axis of the shank 214 to the apex of the tooth. The respective sides or faces of each individual tooth is a mirror image of the other, thus rotation in either direction results in essentially identical geometry.

Loads are transmitted to shank 214 through drum 260, drive portions 264 or 266 and gears 290, 292 from housing 212 as the housing is rotated to drive a fastener such as a nut or bolt using, in the preferred embodiment, standard square drive socket wrench sockets. As with the crown gear embodiment, hex drives, square drives or the like can be driven.

Gear 290 is the driven gear array on drum 260. As is seen in the drawings, the toothed rings 293, 295, 297, 299 and 301 are arranged not only stacked vertically, but arrayed as peripheral rings on drum 260, thereby acting as the drive ring in this embodiment which surrounds the shank 214 within the housing 212. Gears 292 are driving gear array contained on the interior of housing 212. These will be described with reference to FIGS. 13 and 14. In the preferred embodiment gear teeth in gears 290 and 292 have slightly different geometry to allow for distortion under load and to provide clearance at the tips of the teeth to minimize resistance due to fouling of the mechanism from foreign matter or fluids such as lubricant or entrained air during the cycling of the mechanism. As will be described, the entire mechanism is within a sealed body and is designed for compact size where these considerations are material. The different geometry described above is as between the opposed teeth. Nevertheless each set of teeth has bilaterally symmetric teeth, as shown in the drawings, so that loads are transmitted equally in either direction.

As shown in FIG. 12 the gears generally identified as 290 and 292 comprise a series of vertically delineated toothed rings 293, 294, 295, 296, 297, 298, 299, 300, 301 and 302. All are arranged in an annular manner around drum 260 and chamber 304 formed in housing 212. Each of the respective arrays or rings of housing drive gears 294, 296, 298, 300 and 302 in series with inner bearing shoulder 216 define a vertical gap or interruption with the adjacent member. Thus, between gear 294 and 296 is gap 306, between 296 and 298 is gap 308, between gears 298 and 300 is gap 310, between gears 300 and 302 are gap 312 and between gear 302 and inner bearing shoulder 216 is gap 314.

In the preferred embodiment, drum 260 is biased upwardly by springs 316 carried in spring retaining recesses 318. It will be noted that windings 320 in springs 318 are tighter on the portion in gap 314 so that the spring coil walls themselves guide the spring into the recesses 318.

In operation, due to the selection of the relative angular positions of recesses 258 in cam wheel 226 and the corresponding location of drum camming recesses 322, in the same manner as the cam wheel operation in the alternative embodiment FIG. 1 through FIG. 10 camming balls 324 cycle vertically as housing 212 is rotated.

The relative position of camming recesses 258, nesting recesses 322 and camming balls 324 in the preferred embodiment are aligned to move the drum 260 vertically downwardly on the return stroke. This is different from the alternative embodiment and is preferred so that positive engagement of gears 290, 292 is maintained in the rest position of the wrench by virtue of the upward biasing of springs 316. Thus, camming recesses 258, nesting recesses 322 will be normally lined up concentrically as shown in FIG. 11 so that a fastener can be driven because the gears 290, 292 will be engaged.

Figure 13:
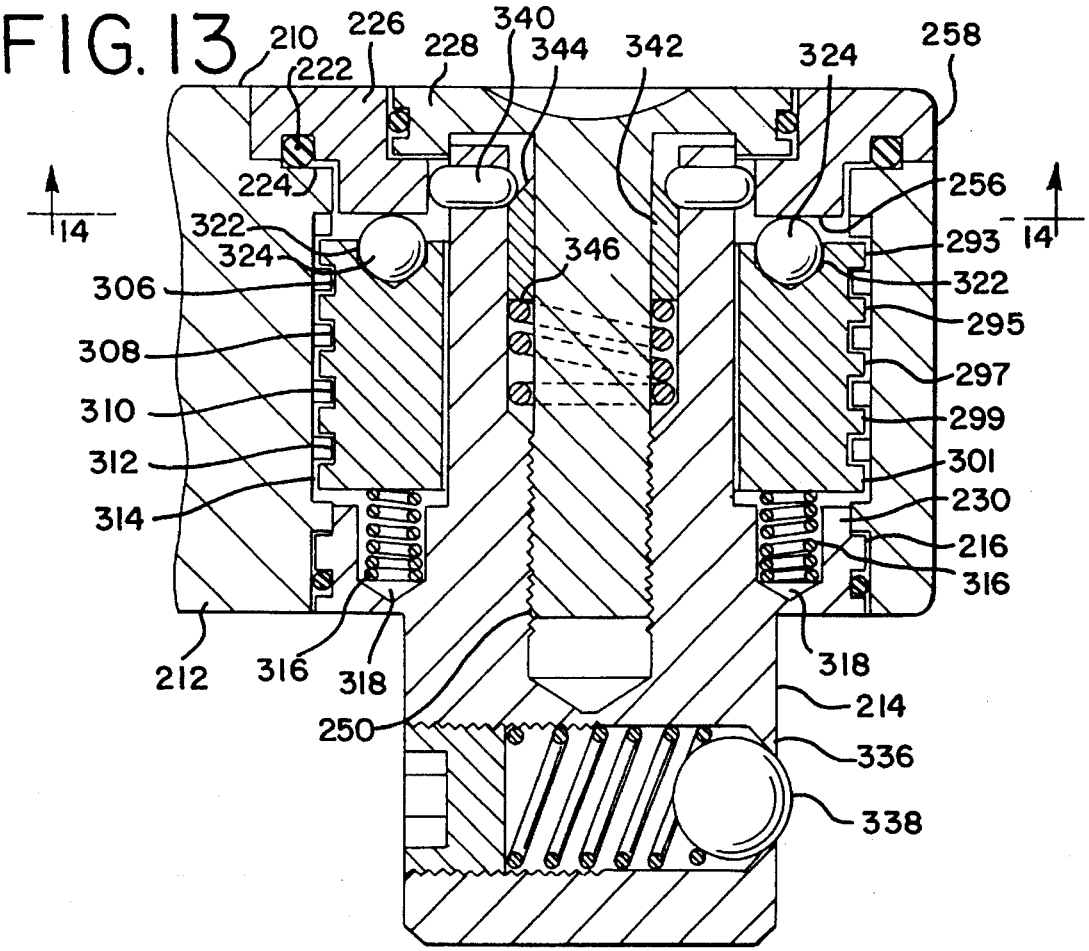
FIG. 13 is a side sectional view of the preferred embodiment.

On moving the housing 212 on the return stroke as shown in FIG. 13, in the preferred embodiment, the conical portion 326 of camming recess 258 and the walls thereof force balls 324 contained in nesting recesses 322 downward thereby forcing the entire drum 260 downward against springs 316 and aligning gear arrays 293, 295, 297, 299 and 301 in gaps 306, 308, 310, 312 and 314, respectively. This disengages the gears 290, 292 permitting the housing to be freely rotated on a return stroke. The cam wheel 226, balls 324, and springs 316 in this preferred ring gear embodiment comprise the biasing assembly which, with the drive ring provides the operative ratcheting action of the tool enabling ratcheting action between the housing 212 and the shank 214 for driving fasteners or otherwise transmitting rotary motion.

Shank 214 has a drive portion 330 comprised of walls 332 for driving a socket wrench socket (not shown). To retain that socket, the preferred embodiment bore 334 includes passageway 336 of a diameter less than a retainer ball 338 so that the retainer ball projects therefrom biased by spring 346. In the preferred embodiment, bore 334 extends at its full diameter substantially the entire distance between walls 332 and joining passageway 336 communicates the entire distance from wall to wall through the entire shank 214. The wall opposite retainer ball 338 is then fitted with a set screw 342 which functions both to close one end of the bore 334, provide a surface against which the spring 340 biases ball 338 and provides for adjustment of the tension of spring 120. This departure over typical socket wrench art using a blind bore, spring and retainer ball has been discussed.

The ratchet action operation of the invention is particularly shown in FIG. 13. A comparison of FIG. 13 and 11 show the return stroke of FIG. 13 and the drive stroke in FIG. 11.

Figure 14:
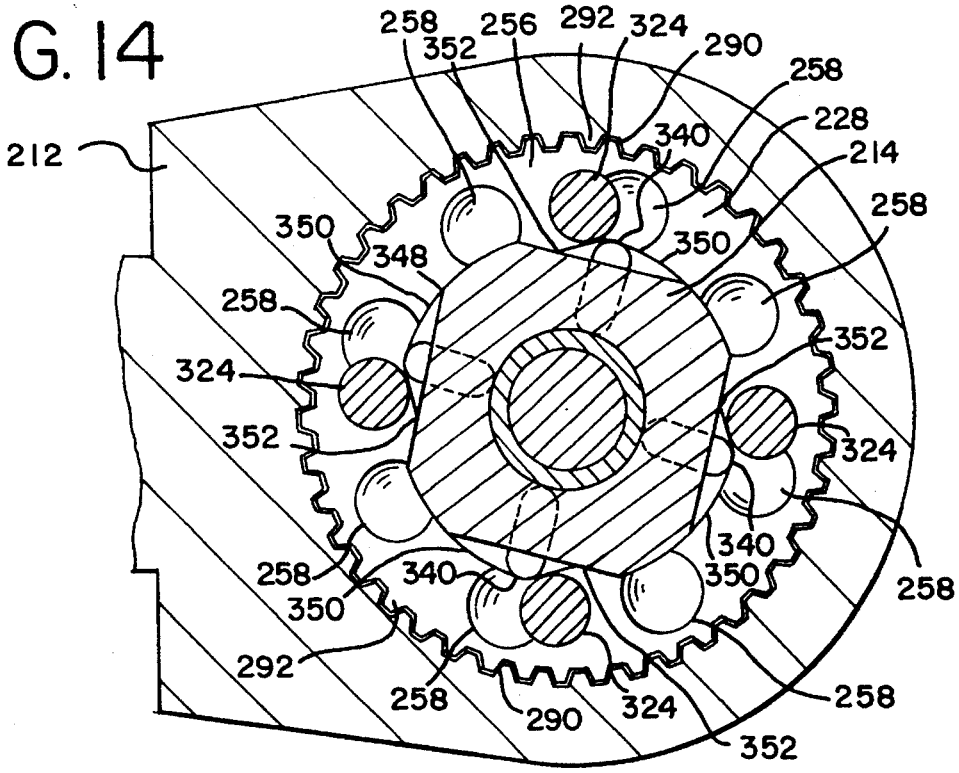
FIG. 14 is a bottom sectional view of the preferred embodiment.

FIG. 13 and 14 show the ratcheting or return stroke position enabling the operation of the ratchet action wrench to be seen. FIG. 13 shows that drive or camming balls 324 and camming recesses 258 are no longer concentric as they are in FIG. 12. This relative displacement caused by the geometry of the walls of recess 258, the conical portion 326 and the surface of balls 324 displaces drum 260 downwardly by virtue of cam surface 256 now bearing on balls 324. This forces gear teeth 290, 292, and 294 out of engagement and thus rotation of housing 212 is free from shank 214 because teeth or gear rings 293, 295, 297, 299, and 301 are in gaps 306, 308, 310, 312 and 314.

The operation of the cam wheel 228 in selecting direction of drive and direction of the return stroke is controlled by a detent assembly. As shown in FIG. 11 and 13 pins 340 are slidingly carried in the top of shank 214. The pins 340 are outwardly biased by collar 342 which is vertically slidably carried on screw 228. Collar 342 has a conical top surface 344 contacting pins 340, which biases the pins 340 outward. Collar 342 is upwardly biased by spring 346 thereby imparting the upward force tending to push the pins 340 outward. As shown in FIG. 14, looking upwardly taken at a line below cam wheel 226, the cam wheel 226 has interior walls 348 having generally arcuate portions 350 and internally projecting shoulders 352. As cam wheel 228 is rotated relative to shank 214 to change the alignment of camming recesses 258, shoulders 352 urge pins 340 inwardly, contacting conical surface 342 and urging sleeve 342 downward against the pressure of spring 346. After the apex of shoulder 352 passes pins 340, the pins are urged outwardly contacting arcuate portions 350. The spring pressure directed through the pins 340, therefore maintains the relative positions of camming recesses 258 and nesting or drum recesses 322 containing balls 324.

The preferred embodiment is completely sealed with O-ring 360 in groove 362 of screw 228 at the top, and o-ring 364 in groove 366 on shank 214. Specifically groove 366 is in a ring 230 formed on shank 214. Ring 230 contains spring recesses 318 and provides the thrust bearing function previously described as it bears on shoulder 216 of housing 212.

The O-rings 222, 360 and 364 provide both sealing functions and increase friction at contact points between relatively moving parts like cam wheel 226 and housing 212, and between shank 214 and housing 212. The angularly offset arrangement of the cam recesses in the cam wheel, the camming balls carried in the nesting recesses in the drive gear (crown type or stacked gear rings) shows the biasing assembly having the selectable properties of direction of ratcheting depending on which set of camming recesses is angularly closest to the balls contained in the nesting recesses, and whether in a normally locked or ratcheting position depending on whether a camming recess or the camming surface is aligned with the ball in the nesting recess, as shown in the two alternative embodiments.

In accordance with my invention I claim:

1. A ratchet action fastening tool with drive and return strokes comprising:

a housing formed with a drive chamber and a shank opening;

a shank rotationally reversible and rotatably carried in the shank opening said shank having a single drive end and a housed end with a longitudinal axis therebetween, whereby said fastening tool has a top and a bottom, and is rotationally reversible while maintaining said top and bottom orientation;

said drive end being mounted to extend out of said housing and said housed end being opposite said drive end and mounted to be maintained within said housing;

a driven gear having bilaterally symmetric teeth vertically slidingly mounted on said shank and rotationally engaging said shank;

a drive gear formed in said chamber, said drive gear also having bilaterally symmetric teeth; and a biasing assembly comprising a cam, and a plurality of camming balls;

said biasing assembly being attached to said housing being selectable between drive direction controlling position and a return direction controlling position, said assembly vertically biasing said driven gear into engagement with said drive gear on a drive stroke and biasing said gear out of said engagement on a return stroke.

2. The tool of claim 1, further comprising:

said driven gear having a first surface and a second surface and a cylindrical exterior and a detent receptacle being formed in said second surface;

said cam being rotatable and carried in close proximity to said drive ring for selecting one of said drive direction controlling position and said return direction controlling position and formed to have a detent recess and a cam surface;

said biasing assembly further having a detent movably carried between the cam and the ring so that when said cam is rotated to said drive controlling position, said detent bears against said cam surface and said receptacle to bias said driven gear into engagement with said drive gear on said drive stroke, and said detent fitable in said recess to release said engagement when on said return stroke.

3. The tool of claim 1 and;

a selection assembly mounted on the housed end with a button and locking ball;

said button having a conical end for moving said locking ball radially outwardly from said axis to lock said biasing assembly in said selectable drive controlling position and said return controlling position, and releasably enabling radially inward movement of said ball to enable selection of said drive controlling position and said return controlling position.

4. The tool of claim 1 and;

said drive end being formed to have a bore extending therethrough perpendicular to said axis;

said bore having a first end being partially closed and a second end adapted to receive an end closure;

a retainer member retractably extending through said first end;

an end closure being removably and adjustably fitted in said second end;

a spring bearing against said end closure and biasing said spring through said first end.

5. The tool of claim 2 and;

a selection assembly mounted on the housed end of said shank with a button and locking ball;

said button having a conical end for moving said locking ball radially outwardly from said axis to lock said biasing assembly in said selectable drive and return positions, and releasably enabling radially inward movement of said locking ball to enable selection of said drive controlling position and said return controlling position.

6. The tool of claim 5 and;

said drive end being formed to have a bore extending therethrough perpendicular to said axis;

said bore having a first end being partially closed and a second end adapted to receive an end closure;

a retainer member retractably extending through said first end;

an end closure being removably and adjustably fitted in said second end;

a spring bearing against said end closure and biasing said spring through said first end.

7. A rotary driver tool having an axis of rotation comprising:

shank means for rotating a fastener;

housing means for housing and rotatably supporting said shank means;

said shank means having a single driving end projecting outwardly from said housing and a housed end opposite said driving end, said housed end being substantially permanently mounted in said housing;

driving means for driving said shank means and imparting rotation thereto about said axis;

selector means for selectively engaging and disengaging said driving means to drive in a first selected direction of rotation and returning in a second direction of rotation, said selector means operative by movement along said axis into engagement with said driving means on movement in a first rotary direction, and to disengage from said driving means on movement in a second direction opposite said first direction;

said selector means further comprising rotatable cam means and a plurality of camming balls whereby the cam means act on said balls to urge said gears into a desired driving relationship.

8. The tool of claim 7 and:

said driving means further comprising a housing formed to provide a chamber for holding said shank means and a peripheral drive gear surrounding the chamber;

said selector means further comprising a driven gear sliding into and out of engagement with the drive gear, and a biasing assembly cammingly moving said driven gear into said engagement on rotation in said first direction, and cammingly releasing said engagement on rotation in said second direction.

9. The tool of claim 8 and said biasing assembly further comprising:

a cam wheel having a gripping edge and a cam surface, said cam surface being provided with a plurality of recesses;

said driven gear having a top surface;

a ball being carried between said cam wheel and said top surface selectively bearing on said cam surface and said top to bias said driven gear into engagement with said drive gear when moved in said first direction and recessing into said recesses thereby disengaging said drive gear and said driven gear when moved in said second direction.

10. The tool of claim 9 and:

a locking assembly connected to said cam wheel for locking said cam wheel in a first position for driving said fastener in a clockwise direction, a second position for rotating said fastener in a counterclockwise direction and a third position for driving said fastener in both directions;

said cam wheel having an interior opening having a plurality of radially inwardly extending shoulders;

said locking assembly having a longitudinally depressible push button;

a locking ball disposed between the push button and the opening;

said push button locking said ball against said shoulders and releasing said ball when depressed thereby permitting realignment of said shoulders to control the direction of rotation of said shank means.

11. The tool of claim 8 and:

said peripheral gear further comprising a first plurality of ring gear arrays having teeth being vertically spaced in relationship to one another to define vertical spaces therebetween, said peripheral gear being within said chamber;

said driven gear further comprising a second plurality of ring gear arrays having teeth being vertically spaced in relationship to one another to define vertical spaces therebetween;

said shank means slidably carried on said driven gear and within said housing means so that said driven gear oscillates along said axis and said first and second ring gear arrays engage one another and disengage one another as said teeth align with said spaces.

12. The tool of claim 8 and:

said peripheral gear further comprising a crown gear having radially oriented teeth, said peripheral gear being within said chamber at one end;

said driven gear further comprising a second crown gear having radially oriented teeth;

said shank means slidably carried on said driven gear and within said housing means so that said driven gear oscillates along said axis and said first and second crown gears engage one another and disengage one another as said driven gear teeth diverge from said peripheral gear teeth.

13. A drive member for imparting rotary motion comprising:

a shank rotatable around an axis;

a housing containing said shank;

a drive disposed in the housing between the shank and the housing for selectively transmitting rotational motion in a drive rotational direction from the housing to the shank, by non-rotational movement of said drive along said axis;

said drive having a first array of teeth;

said housing having a second array of teeth;

movement between the housing and drive being accomplished by the engagement of said first array of teeth and said second array of teeth;

said housing second teeth and said drive first teeth being disengaged for a return when moved in the release rotational direction, being opposite said drive rotational direction;

said axial movement being accomplished through the action of a cam said cam being disposed between said housing and said drive, said cam being operatively arranged so that a positive mechanical engagement between said first teeth and said second teeth is maintained on the drive stroke and said axial movement of the teeth is also accomplished by a positive mechanical engagement between the cam and the drive;

said positive mechanical engagement being accomplished through balls contained between said cam and said drive.

14. The drive member of claim 13, further comprising:

said drive being a drum having said first array of teeth disposed about its periphery;

said housing having a chamber in which said drive is operatively positioned;

said chamber having said second array of teeth formed and arranged about its interior for engagement and disengagement of said first plurality of gear teeth;

said cam operatively axially biasing said balls and said drum upon rotating said housing.

15. The drive member of claim 14, said drive further comprising:

said cam being a cam wheel having a cam surface and a first plurality of recesses and a second plurality of recesses formed therein;

said surface contacting said balls and camming said balls to bias said drum for said selective transmitting of rotational motion when said housing is moved in said drive rotational direction;

said first plurality of recesses receiving said balls to terminate said biasing when said housing is moved in said first release rotational direction when the cam wheel is in a first controlling position, said first release rotational direction being a clockwise direction;

said second plurality of recesses receiving said balls to terminate said biasing when said housing is moved in a second release rotational direction when the cam wheel is in a second controlling position, said second release rotational direction being a counterclockwise direction, whereby said cam wheel provides control of direction in a ratcheting like manner and said ratcheting direction is reversible.

16. The drive member of claim 15, said drive further comprising:

said first plurality of gear teeth being formed and arranged as a plurality of vertically arrayed ring gears having first spaces vertically therebetween;

said second plurality of gear teeth being formed and arranged as a plurality of vertically arrayed ring gears having second spaces vertically therebetween;

said housing driving said drum and said shank upon rotation in said drive rotational direction by engagement of said first plurality of gear teeth and said second plurality of gear teeth;

said housing being disengaged from said drum by disengagement of said first plurality of gear teeth and said second plurality of gear teeth, said first plurality of gear teeth rotating relative to said second plurality of gear teeth by alignment of the respective teeth in the opposed spaces.

17. The drive member of claim 15, said drive further comprising:

said cam wheel being selectable to a third controlling position in which said pluralities of gear teeth remain engaged when said housing is moved in both said drive rotational direction and said release rotational direction.

18. The drive member of claim 17, said drive further comprising:

said first plurality of gear teeth being initially biased so as to be separated from said second plurality of gear teeth when said housing is at rest and disengaging on movement in said release rotational direction.

* * * * *